US012628881B2

(12) United States Patent
Prestia

(10) Patent No.: US 12,628,881 B2
(45) Date of Patent: May 19, 2026

(54) CHARGER FOR AEROSOL-GENERATING DEVICE WITH INSERTION MECHANISM

(71) Applicant: Philip Morris Products S.A., Neuchatel (CH)

(72) Inventor: Ivan Prestia, Milan (IT)

(73) Assignee: Philip Morris Products S.A., Neuchatel (CH)

( * ) Notice: Subject to any disclaimer, the term of this patent is extended or adjusted under 35 U.S.C. 154(b) by 669 days.

(21) Appl. No.: 18/246,588

(22) PCT Filed: Sep. 23, 2021

(86) PCT No.: PCT/EP2021/076171
§ 371 (c)(1),
(2) Date: Mar. 24, 2023

(87) PCT Pub. No.: WO2022/069335
PCT Pub. Date: Apr. 7, 2022

(65) Prior Publication Data

US 2023/0371615 A1 Nov. 23, 2023

(30) Foreign Application Priority Data

Sep. 30, 2020 (EP) ..... 20199373

(51) Int. Cl.
*A24F 40/95* (2020.01)

(52) U.S. Cl.
CPC ..... *A24F 40/95* (2020.01)

(58) Field of Classification Search
CPC ..... A24F 40/90; A24F 40/95
See application file for complete search history.

(56) References Cited

U.S. PATENT DOCUMENTS

2012/0227753 A1* 9/2012 Newton ..... A24F 40/95 131/347
2015/0245654 A1 9/2015 Memari et al.
(Continued)

FOREIGN PATENT DOCUMENTS

CN 204969481 U 1/2016
CN 107692327 A 2/2018
(Continued)

OTHER PUBLICATIONS

Russian Search Report issued Sep. 5, 2023 in Russian Patent Application No. 2023107799/03 (with English Translation), 4 pages.
(Continued)

*Primary Examiner* — Cynthia Szewczyk
(74) *Attorney, Agent, or Firm* — Oblon, McClelland, Maier & Neustadt, L.L.P.

(57) ABSTRACT

A charger if provided for an aerosol-generating device, the charger including: a cavity configured to receive the aerosol-generating device and an insertion mechanism, the insertion mechanism including an insertion stage configured to insert the aerosol-generating device into the cavity, and a charging stage configured to move the aerosol-generating device into a charging position, and the insertion mechanism being configured to automatically initiate operation of the charging stage at an end of operation of the insertion stage. A kit including the charger, and a method for charging the aerosol-generating device, are also provided.

19 Claims, 4 Drawing Sheets

(56) References Cited

U.S. PATENT DOCUMENTS

Figures 1, 1A, 1B, 1C:
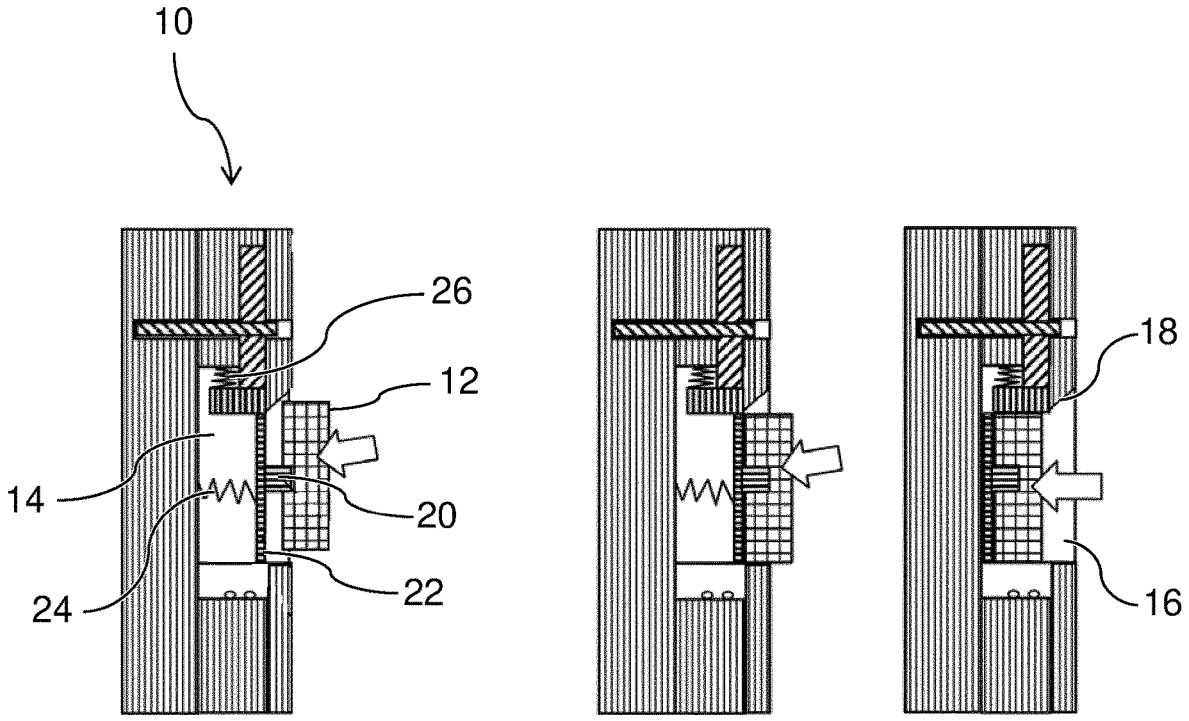

| | | | |
|---|---|---|---|
| 2015/0245655 | A1 | 9/2015 | Memari et al. |
| 2015/0245656 | A1 | 9/2015 | Memari et al. |
| 2015/0245657 | A1 | 9/2015 | Memari et al. |
| 2015/0245662 | A1 | 9/2015 | Memari et al. |
| 2015/0245663 | A1 | 9/2015 | Memari et al. |
| 2015/0245664 | A1 | 9/2015 | Memari et al. |
| 2015/0245665 | A1 | 9/2015 | Memari et al. |
| 2015/0245666 | A1 | 9/2015 | Memari et al. |
| 2015/0245667 | A1 | 9/2015 | Memari et al. |
| 2015/0245668 | A1 | 9/2015 | Memari et al. |
| 2015/0359266 | A1 | 12/2015 | Memari et al. |
| 2016/0150824 | A1 | 6/2016 | Memari et al. |
| 2016/0192712 | A1 | 7/2016 | Memari et al. |
| 2016/0192713 | A1 | 7/2016 | Memari et al. |
| 2017/0360105 | A1 | 12/2017 | Memari et al. |
| 2017/0360106 | A1 | 12/2017 | Memari et al. |
| 2017/0360107 | A1 | 12/2017 | Memari et al. |
| 2017/0360108 | A1 | 12/2017 | Memari et al. |
| 2017/0360109 | A1 | 12/2017 | Memari et al. |
| 2017/0360110 | A1 | 12/2017 | Memari et al. |
| 2017/0360111 | A1 | 12/2017 | Memari et al. |
| 2017/0360112 | A1 | 12/2017 | Memari et al. |
| 2017/0360113 | A1 | 12/2017 | Memari et al. |
| 2017/0360114 | A1 | 12/2017 | Memari et al. |
| 2017/0360115 | A1 | 12/2017 | Memari et al. |
| 2017/0360116 | A1 | 12/2017 | Memari et al. |
| 2018/0000162 | A1 | 1/2018 | Memari et al. |
| 2018/0000163 | A1 | 1/2018 | Memari et al. |
| 2018/0049474 | A1 | 2/2018 | Memari et al. |
| 2018/0049475 | A1 | 2/2018 | Memari et al. |
| 2018/0271158 | A1 | 9/2018 | Memari et al. |
| 2018/0271159 | A1 | 9/2018 | Memari et al. |
| 2018/0271160 | A1 | 9/2018 | Memari et al. |
| 2018/0271161 | A1 | 9/2018 | Memari et al. |
| 2018/0271162 | A1 | 9/2018 | Memari et al. |
| 2018/0271163 | A1 | 9/2018 | Memari et al. |
| 2018/0271164 | A1 | 9/2018 | Memari et al. |
| 2018/0271165 | A1 | 9/2018 | Memari et al. |
| 2018/0271166 | A1 | 9/2018 | Memari et al. |
| 2018/0271167 | A1 | 9/2018 | Memari et al. |
| 2019/0069603 | A1 | 3/2019 | Memari et al. |
| 2020/0008483 | A1 | 1/2020 | Memari et al. |
| 2020/0008484 | A1 | 1/2020 | Memari et al. |
| 2020/0008485 | A1 | 1/2020 | Memari et al. |
| 2020/0008486 | A1 | 1/2020 | Memari et al. |
| 2020/0008487 | A1 | 1/2020 | Memari et al. |
| 2020/0008488 | A1 | 1/2020 | Memari et al. |
| 2020/0008489 | A1 | 1/2020 | Memari et al. |
| 2020/0008490 | A1 | 1/2020 | Memari et al. |
| 2020/0008491 | A1 | 1/2020 | Memari et al. |
| 2020/0008492 | A1 | 1/2020 | Memari et al. |
| 2020/0022420 | A1 | 1/2020 | Memari et al. |
| 2020/0214352 | A1 | 7/2020 | Memari et al. |
| 2020/0245689 | A1 | 8/2020 | Holzherr et al. |
| 2021/0045449 | A1 | 2/2021 | Memari et al. |
| 2021/0127757 | A1* | 5/2021 | Lee ..... A24F 40/95 |
| 2021/0360981 | A1 | 11/2021 | Memari et al. |

FOREIGN PATENT DOCUMENTS

| | | | | |
|---|---|---|---|---|
| CN | 111031827 | A | 4/2020 | |
| CN | 211048399 | U | 7/2020 | |
| CN | 109068757 | B * | 4/2021 | ..... H02J 7/0045 |
| GB | 2534212 | B | 7/2016 | |
| JP | 2017-513513 | A | 6/2017 | |
| RU | 2 707 892 | C2 | 10/2019 | |
| WO | WO-2018217030 | A1 * | 11/2018 | ..... A24B 15/16 |
| WO | WO 2019/090937 | A1 | 5/2019 | |

OTHER PUBLICATIONS

International Search Report & Written Opinion issued Jan. 12, 2022 in PCT/EP2021/076171, filed on Sep. 23, 2021, 14 pages.

Written Opinion of the International Preliminary Examining Authority (IPEA) mailed on Aug. 25, 2022 in PCT/EP2021/076171, filed on Sep. 23, 2021, 9 pages.

European Search Report issued Mar. 1, 2021 in European application 20199373.0 filed Sep. 30, 2020, 9 pages.

Japanese Office Action issued May 30, 2024 in Japanese Patent Application No. 2023-519874 (with English Translation), 6 pages.

Office Action dated Jan. 28, 2026, issued in corresponding Chinese patent application No. 202180063514.X (citing documents 1-3).

* cited by examiner

Fig. 2
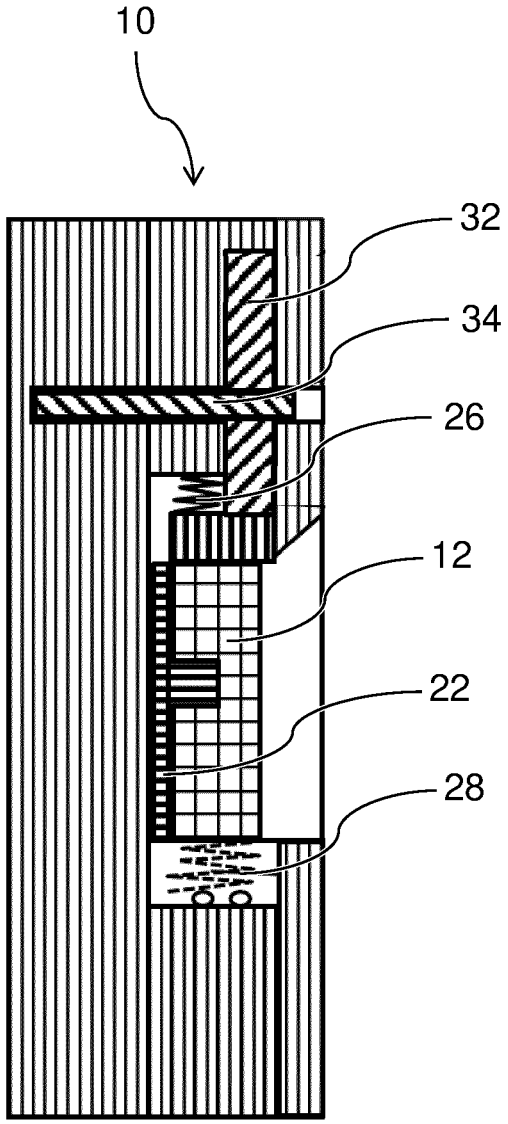
Fig. 2a
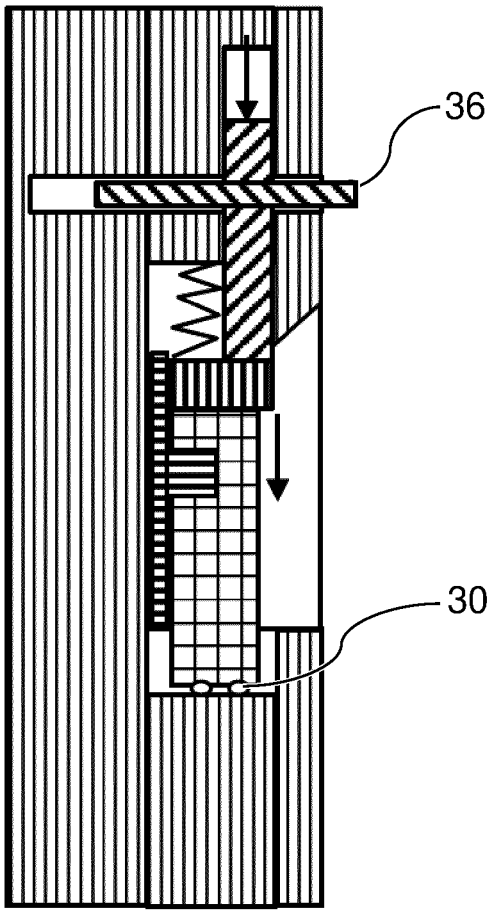
Fig. 2b

CHARGER FOR AEROSOL-GENERATING DEVICE WITH INSERTION MECHANISM

The present disclosure relates to a charger for an aerosol-generating device. The present disclosure further relates to a kit comprising the charger and an aerosol-generating device and, optionally, an aerosol-generating article. The present disclosure further relates a method for charging an aerosol-generating device.

It is known to provide an aerosol-generating device for generating an inhalable aerosol. Such devices may heat an aerosol-forming substrate contained in an aerosol-generating article without burning the aerosol-forming substrate. The aerosol-generating article may have a rod shape configured for insertion into a heating chamber of the aerosol-generating device. A heating element is arranged in or around the heating chamber for heating the aerosol-forming substrate once the aerosol-generating article is inserted into the heating chamber. The heater of such aerosol-generating devices is often powered by a rechargeable battery of the device.

It is further known to provide a separate charger for an aerosol-generating device for releasably holding and recharging the aerosol-generating device when not in use. The charger itself may be powered by a battery which may be rechargeable. Alternatively, or in addition, the charger may charge the device via an external electricity supply.

The charger may comprise a body, a rechargeable electrical power supply housed in the body, and a cavity for receiving the electrically operated aerosol-generating device. Typically, the aerosol-generating device must be aligned coaxially with the cavity to insert the aerosol-generating device for charging. Some chargers even require a specific rotational orientation of the aerosol-generating device relative to the charging unit to match the corresponding electrical contacts.

Aerosol-generating devices often have an elongated shape or accommodate a rod-shaped aerosol-generating article. Aerosol-generating devices typically have a high aspect ratio, having a first, longitudinal, dimension that is greater in magnitude than second and third, width, dimensions. Chargers for holding aerosol-generating devices often comprise housings defining narrow openings into which a user is required to insert the device. The narrow openings typically have a width similar to the width of the aerosol-generating device. Users inserting an aerosol-generating device into these cases are generally required to closely align the aerosol-generating device with the narrow opening to insert the aerosol-generating device into the case, and then slide the aerosol-generating device longitudinally into the case to ensure a proper electrical connection between the aerosol-generating device and a charger.

It would be desirable to improve the ease with which a user is able to electrically connect an aerosol-generating device and a charger. It would be desirable to have a charger into which a device can be inserted by using only one hand. It would be desirable to have a charger into which a device can be inserted without looking. It would further be desirable to provide means to improve the electrical connection between an aerosol-generating device and a charging unit. It would also be desirable to improve the speed and ease with which a user is able to remove the aerosol-generating device from the charging device.

According to an embodiment of the invention there is provided a charger for an aerosol-generating device. The charger may comprise a cavity for receiving the device. The charger may comprise an insertion mechanism. The insertion mechanism may comprise an insertion stage for inserting the device into the cavity. The insertion mechanism may comprise a charging stage for moving the device into a charging position. The insertion mechanism may be configured for automatically initiating operation of the charging stage at the end of operation of the insertion stage.

According to an embodiment of the invention there is provided a charger for an aerosol-generating device. The charger comprises a cavity for receiving the device and an insertion mechanism. The insertion mechanism comprises an insertion stage for inserting the device into the cavity. The insertion mechanism further comprises a charging stage for moving the device into a charging position. The insertion mechanism is configured for automatically initiating operation of the charging stage at the end of operation of the insertion stage.

As used herein, the terms 'insertion stage', 'charging stage', and 'ejection stage' refer to a configuration of components of the insertion mechanism of the charger for operating sequences of insertion, charging, and ejection of the aerosol-generating device, respectively.

Operation of the insertion stage may comprise moving the aerosol-generating device from an initial insertion position into a final insertion position along at least a first direction. At the end of operation of the insertion stage, the device may be in the final insertion position. The cavity may be configured for completely enclosing the device in the final insertion position. Operation of the charging stage may comprise moving the aerosol-generating device from the final insertion position into a charging position along at least a second direction. At the end of operation of the charging stage, the device may be in the charging position. The cavity may be configured for completely enclosing the device in the charging position. The device may be charged when being in the charging position. Operation of the ejection stage may comprise moving the aerosol-generating device from the charging position into an ejection position. The ejection position may correspond to the initial insertion position. Operation of the ejection stage may comprise reverse operation of the charging stage and the insertion stage. Operation of the ejection stage may comprise reversely moving the aerosol-generating device from the charging position back into the initial insertion position.

A component of a stage configured for operating a sequence may, at the same time, be a component of another stage configured for operating another sequence. For example, a spring mechanism may be part of the insertion stage and may be compressed during the insertion sequence. At the same time, the spring mechanism may be part of the ejection stage and may be relaxed during the ejection sequence.

By providing the charger of the invention, insertion of an aerosol-generating device may be simplified. The charger of the invention may be particularly advantageous in low light conditions or when the user is driving a car while keeping a continuous visual focus and attention on the road. By providing the charger of the invention, the speed and ease with which a user is able to electrically connect an aerosol-generating device and a charger may be improved. Insertion of an aerosol-generating device into the charger of the invention may not require a coordinated movement of both hands of the user. By the charger of the invention, a charger may be provided into which a device can be inserted by using only one hand. By the charger of the invention, a charger may be provided into which a device can be inserted without looking. This may be achieved by the insertion mechanism of the charger of the invention taking over the fine adjustment of orientation, positioning, and movement of the aerosol-generating device towards the charger.

By providing the charger of the invention, an additional hinged cover that may be present in current chargers may become unnecessary. Thereby, handling of the charger may be simplified. By providing the charger of the invention, the electrical connection between an aerosol-generating device and a charging unit may be improved. By providing the charger of the invention, the speed and ease with which a user is able to remove the aerosol-generating device from the charging device may be improved.

The insertion stage may be configured for moving the device in a first direction, and the charging stage may be configured for moving the device in at least a second direction different from the first direction. The second direction may be substantially orthogonal to the first direction. The first direction may be orthogonal to one or both of a longitudinal direction of the device and a longitudinal direction of the charger.

The insertion stage may be configured for one or both of linearly and rotationally moving the device along the first direction. The charging stage may be configured for one or both of linearly and rotationally moving the device along the second direction.

The insertion stage may be configured for moving the device along the first direction both linearly in a direction orthogonal to a longitudinal axis of the device and rotationally around the longitudinal axis of the device.

The insertion stage may be configured for moving the device along the first direction both linearly in a direction orthogonal to a longitudinal axis of the device and rotationally by pivoting the longitudinal axis of the device. Pivoting the longitudinal axis of the device may refer to a rotational movement of the longitudinal axis of the device with respect to the longitudinal axis of the charger during operation of the insertion stage. For example, the longitudinal axis of the device may be tilted with respect to the longitudinal axis of the charger in the initial insertion position, and the longitudinal axis of the device may be collinear to the longitudinal axis of the charger in the final insertion position.

The charger may comprise a motor mechanism, preferably a motorized gear. The insertion mechanism may comprise a motor mechanism, preferably a motorized gear.

The charger may comprise one or both of a spring mechanism and a motor mechanism for moving the device along the first direction. The charger may comprise one or both of a spring mechanism and a motor mechanism for moving the device along the second direction.

The insertion stage may comprise one or both of a spring mechanism and a motor mechanism configured for being activated during at least part of operation of the insertion stage.

The charging stage may be configured for exerting a force onto the device so as to press electrical contacts of the device onto electrical contacts of the charger in the charging position. The charging stage may be configured for exerting the force along a longitudinal direction of the device so as to cause a movement of the device parallel to a longitudinal axis of the device towards the electrical contacts of the charger. The charging stage may comprise one or both of a spring mechanism and a motor mechanism configured for exerting the force onto the device and configured for being activated at the end of operation of the insertion stage. The mechanism may be configured to be activated when the device is fully pushed against a backwall of the cavity. The mechanism may be configured to move a button to protrude out of a charger outside surface, such that by pressing on the button the mechanism may be moved back, releasing the force exerted on the device.

The charger may comprise an elongated opening for lateral insertion of the device into the cavity via a longitudinal side of the device. The longitudinal side generally refers to the longest side of the device or the charger. By inserting the device via its longitudinal side into an elongated opening, insertion dimensions are maximized. It may be easier for a user to insert the device via its longitudinal side into a bigger longitudinal opening in comparison to inserting the device via a smaller side of the device into a correspondingly smaller opening. For example, it may be easier for a driver of a car to put the device into a bigger opening while keeping a continuous visual focus and attention on the road.

A sidewall of the opening may comprise a funnel shape towards the cavity for guiding the device into the cavity. In other words, the size of the opening may decrease in a direction towards the inside of the cavity. A user may easily find the large charger opening. A user may easily properly insert the device inside the charger, helped by the guidance of the progressively narrowing one or more walls of the charger opening.

The elongated opening may be arranged at a longitudinal side of the charger. The charger may be arranged such that a longitudinal axis of the charger is parallel to a longitudinal axis of the aerosol-generating device when the device is inserted into the opening.

The cavity may be configured for completely enclosing the device in the charging position. The inside of the charger may be water and dust resistant according to Ingress Protection Code IP64 or above. This may advantageously allow the charger to protect the device from water and dust. IP or Ingress Protection ratings are defined in international standard EN 60529. They are used to define levels of sealing effectiveness of electrical enclosures against intrusion from foreign bodies (for example tools or dirt) and moisture. IP64 refers to an enclosure being totally dust tight, that is, full protection against dust and other particulates, including a vacuum seal, tested against continuous airflow. IP64 further refers to an enclosure being protected against water splashes from all directions tested for a minimum of 10 minutes with an oscillating spray (limited ingress permitted with no harmful effects).

The charger may comprise a set of charging terminals configured for being connected to a corresponding set of charging terminals of the aerosol-generating device. The charger may comprise two sets of charging terminals symmetrically arranged at opposing walls in the cavity, such that the device can be charged when inserted in either up or down orientation. A user may thus insert the device into the charger without paying attention to the orientation of the device. This may simplify handling of the charger.

The charger may comprise a movable back wall. The movable back wall may be mounted in the cavity. The movable back wall may be part of one or both of the insertion stage and the ejection stage. The movable back wall may be configured for contacting the aerosol-generating device. The movable back wall may be configured for moving in the cavity and against a wall of the cavity during operation of the insertion stage. The movable back wall may be configured for a reverse movement during operation of the ejection stage. The movable back wall may be moved by one or both of a spring mechanism and a motor mechanism of the charger.

The insertion stage may comprise a clamp for grasping the device. The clamp may simplify insertion of the device. The clamp may support the correct orientation of the device when inserted into the charger. The clamp may be mounted onto the movable back wall of the charger. The insertion stage may comprise a magnetic surface for grasping the device. The movable back wall of the charger may comprise the magnetic surface. The device may have a corresponding magnetic surface.

The charger may be configured for use in a vehicle. The charger may comprise means for mounting the charger into a vehicle. For example, the charger may comprise a car ventilation bracket or a motorcycle handlebar holder.

The insertion mechanism may comprise an ejection stage for at least partly removing the charged device out of the cavity into an ejection position. This may allow for the device to be easily grasped by a user. Operation of the ejection stage may be automatically initiated when the device is charged. The ejection stage may comprise a user interface for a user to manually initiate operation of the ejection stage. The user interface may comprise a button.

The ejection stage may be configured for reverse operation of at least a part of one or both of the charging stage and the insertion stage.

The invention further relates to a kit comprising the charger as described herein and an aerosol-generating device. The kit may comprise an aerosol-generating article. One or both of the charger, the aerosol-generating device, and the aerosol-generating article may have an elongated shape. A longitudinal axis of the charger may be parallel to a longitudinal axis of the aerosol-generating device, when the aerosol-generating device is inserted into the charger.

The invention further relates to a method for charging an aerosol-generating device. The method comprises providing a charger as described herein. The method further comprises providing and an aerosol-generating device. The method further comprises moving the device along a first direction into the cavity and moving the device along a second direction into the charging position. A longitudinal axis of the device may be substantially parallel to a longitudinal axis of the charger while the device is being moved along one or both of the first direction and the second direction. The first direction may be substantially orthogonal to the second direction.

The method may further comprise a step of charging the device in the charging position.

The method may further comprise a step of ejecting the device from the charging position into an ejection position. The step of ejecting the device from the charging position into an ejection position may comprise reverse movement of the device out of the charging position along the second direction and along the first direction.

The charger may comprise a primary power source. The aerosol-generating device may comprise a secondary power source. An external power connection may be coupled to electric circuitry of the charger. For example, the external power connection may be compatible with USB or micro USB connections. The external power connection may be used to provide power for charging the aerosol-generating device.

The charger may include a power storage unit. For example, the charger may include a battery. The battery may be used to provide portable power for charging the aerosol-generating device. The battery of the charger may be able to store more charge than the battery of the aerosol-generating device.

The charger may have a docking arrangement configured to engage with the aerosol-generating device for charging of the secondary power source by the primary power source. The docking arrangement may comprise one or more sets of electrical contacts serving as coupling members. The coupling members may comprise data contacts, for example, data contacts that allow transfer of data between the aerosol-generating device and the charging device.

The charger may be configured to receive the aerosol-generating device. The charger may have any suitable size and shape for receiving the aerosol-generating device. Typically, the charger is portable. In other words, the charger has a suitable size and shape to be carried by a user. The charger may have a size and shape similar to a packet of cigarettes. The charger may have any suitable maximum transverse cross-section and any suitable length. In some embodiments, the charger may have a shape, maximum transverse cross-section and length substantially similar to a conventional pack of cigarettes. The charger may have a length between about 50 mm and about 200 mm. The charger may have an external diameter, or maximum transverse cross-section, of between about 10 mm and about 50 mm. The charger may have a transverse cross-section of any suitable shape. For example, the charger may have a substantially circular, elliptical, triangular, square, rhomboidal, trapezoidal, pentagonal, hexagonal or octagonal transverse cross-section. The charger may have a substantially constant transverse cross-section along its length. The charger may have a substantially rectangular transverse cross-section along its length. In particular embodiments, the charger may be a substantially rectangular cuboid.

A housing may generally form the shape of the charging device. The housing may comprise one or more walls. In particular embodiments, the housing may be a substantially rectangular cuboid. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. In particular embodiments, the material is light and non-brittle.

The aerosol-generating device may be a handheld device. In other words, the aerosol-generating device may have any size and shape suitable to be held in the hand of a user. The aerosol-generating device may have a size and shape similar to a conventional cigarette or cigar. The aerosol-generating device may be portable. The aerosol-generating device may have any suitable size and shape. The aerosol-generating device may have a transverse cross-section of any suitable shape. For example, the aerosol-generating device may have a substantially circular, elliptical, triangular, square, rhomboidal, trapezoidal, pentagonal, hexagonal or octagonal transverse cross-section. In some particular embodiments, the aerosol-generating device has a substantially circular transverse cross-section. The aerosol-generating device may have a substantially constant transverse cross-section along its length. The aerosol-generating device may have a substantially circular transverse cross-section along its length. The device may have rotational symmetry about its longitudinal axis. The device may have rotational symmetry of an order greater than one about its longitudinal axis. The device may be substantially axisymmetric about its longitudinal axis. In particular embodiments, the aerosol-generating device may be substantially circularly cylindrical.

The aerosol-generating device may have any suitable diameter (maximum transverse cross-section) and any suitable length. The aerosol-generating device may be elongate. In some particular embodiments, the aerosol-generating device may have a shape, diameter and length substantially similar to a conventional cigarette or cigar. The aerosol-generating device may have a length between about 30 mm and about 150 mm. The aerosol-generating device may have an external diameter between about 5 mm and about 30 mm.

The aerosol-generating device may be an elongated aerosol-generating device having a proximal end, a distal end, and a body extending between the proximal end and the distal end.

As used herein, the terms 'upstream', 'downstream', 'proximal' and 'distal' are used to describe the relative positions of components, or portions of components, of aerosol-generating devices, aerosol-generating articles and cases.

As used herein, the term 'longitudinal' is used to describe the direction between a downstream, proximal or mouth end and the opposed upstream or distal end and the term 'transverse' is used to describe the direction perpendicular to the longitudinal direction.

As used herein, the term 'length' is used to describe the maximum longitudinal dimension between the distal or upstream end and the proximal or downstream end of components, aerosol-generating devices, aerosol-generating articles and cases.

As used herein, the term 'diameter' is used to describe the maximum transverse dimension of components, for example aerosol-generating devices and aerosol-generating articles.

As used herein, the term 'transverse cross-section' is used to describe the cross-section of components, aerosol-generating devices, aerosol-generating articles and charging devices in the direction perpendicular to the major axis of the components, aerosol-generating devices, aerosol-generating articles and cases, respectively.

As used herein, the term 'aerosol-forming substrate' refers to a substrate capable of releasing volatile compounds that can form an aerosol. The volatile compounds may be released by heating or combusting the aerosol-forming substrate. As an alternative to heating or combustion, in some cases, volatile compounds may be released by a chemical reaction or by a mechanical stimulus, such as ultrasound. The aerosol-forming substrate may be solid or liquid or may comprise both solid and liquid components. An aerosol-forming substrate may be part of an aerosol-generating article.

As used herein, the term 'aerosol-generating article' refers to an article comprising an aerosol-forming substrate that is capable of releasing volatile compounds that can form an aerosol. An aerosol-generating article may be disposable.

As used herein, the term 'aerosol-generating device' refers to a device that interacts with an aerosol-forming substrate to generate an aerosol. An aerosol-generating device may interact with one or both of an aerosol-generating article comprising an aerosol-forming substrate, and a cartridge comprising an aerosol-forming substrate. In some examples, the aerosol-generating device may heat the aerosol-forming substrate to facilitate release of volatile compounds from the substrate. An electrically operated aerosol-generating device may comprise an atomiser, such as an electric heater, to heat the aerosol-forming substrate to form an aerosol.

As used herein, the term 'aerosol-generating system' refers to the combination of an aerosol-generating device with an aerosol-forming substrate. When the aerosol-forming substrate forms part of an aerosol-generating article, the aerosol-generating system refers to the combination of the aerosol-generating device with the aerosol-generating article. In the aerosol-generating system, the aerosol-forming substrate and the aerosol-generating device cooperate to generate an aerosol.

Below, there is provided a non-exhaustive list of non-limiting examples. Any one or more of the features of these examples may be combined with any one or more features of another example, embodiment, or aspect described herein.

Example 1: A charger for an aerosol-generating device, comprising a cavity for receiving the device and an insertion mechanism;

wherein the insertion mechanism comprises an insertion stage for inserting the device into the cavity, and a charging stage for moving the device into a charging position; and wherein the insertion mechanism is configured for automatically initiating operation of the charging stage at the end of operation of the insertion stage.

Example 2: The charger according to Example 1, wherein the insertion stage is configured for moving the device in a first direction, and the charging stage is configured for moving the device in at least a second direction different from the first direction.

Example 3: The charger according to Example 2, wherein the insertion stage is configured for one or both of linearly and rotationally moving the device along the first direction.

Example 4: The charger according to Example 2 or Example 3, wherein the charging stage is configured for one or both of linearly and rotationally moving the device along the second direction.

Example 5: The charger according to any of Examples 2 to 4, wherein the first direction is orthogonal to one or both of a longitudinal direction of the device and a longitudinal direction of the charger.

Example 6: The charger according to any of Examples 2 to 5, wherein the second direction is substantially orthogonal to the first direction.

Example 7: The charger according to any of the preceding examples, wherein the charging stage is configured for exerting a force onto the device so as to press electrical contacts of the device onto electrical contacts of the charger in the charging position.

Example 8: The charger according to Example 7, wherein the charging stage is configured for exerting the force along a longitudinal direction of the device so as to cause a movement of the device parallel to a longitudinal axis of the device towards the electrical contacts of the charger.

Example 9: The charger according to Example 7 or Example 8, wherein the charging stage comprises one or both of a spring mechanism and a motor mechanism configured for exerting the force onto the device and configured for being activated at the end of operation of the insertion stage.

Example 10: The charger according to Example 9, wherein the mechanism is configured to be activated when the device is fully pushed against a backwall of the cavity.

Example 11: The charger according to Example 9 or Example 10, wherein the mechanism is configured to move a button to protrude out of a charger outside surface, such that by pressing on the button the mechanism may be moved back, releasing the force exerted on the device.

Example 12: The charger according to any of the preceding examples, wherein the insertion stage comprises one or both of a spring mechanism and a motor mechanism configured for being activated during at least part of the operation of the insertion stage.

Example 13: The charger according to any of the preceding examples, comprising an elongated opening for lateral insertion of the device into the cavity via a longitudinal side of the device.

Example 14: The charger according to Example 13, wherein a sidewall of the opening has a funnel shape towards the cavity for guiding the device into the cavity.

Example 15: The charger according to Example 13 or Example 14, wherein the elongated opening is arranged at a longitudinal side of the charger.

Example 16: The charger according to Example 15, wherein the charger is arranged such that a longitudinal axis of the charger is parallel to a longitudinal axis of the aerosol-generating device when the device is inserted into the opening.

Example 17: The charger according to any of the preceding examples, wherein the cavity is configured for completely enclosing the device in the charging position.

Example 18: The charger according to any of the preceding examples, wherein the inside of the charger is water and dust resistant according to IP64 or above.

Example 19: The charger according to any of the preceding examples, wherein the charger comprises two sets of charging terminals symmetrically arranged at opposing walls in the cavity, such that the device can be charged when inserted in either up or down orientation.

Example 20: The charger according to any of the preceding examples, wherein the insertion stage comprises a clamp for grasping the device.

Example 21: The charger according to any of the preceding examples, wherein the insertion stage comprises a magnetic surface for grasping the device.

Example 22: The charger according to any of the preceding examples, wherein the charger is configured for use in a vehicle.

Example 23: The charger according to any of the preceding examples, wherein the charger comprises means for mounting the charger into a vehicle.

Example 24: The charger according to any of the preceding examples, wherein the insertion mechanism comprises an ejection stage for partly removing the charged device out of the cavity into an ejection position.

Example 25: The charger according to Example 24, wherein operation of the ejection stage is automatically initiated when the device is charged.

Example 26: The charger according to Example 24, wherein the ejection stage comprises a user interface for a user to manually initiate operation of the ejection stage.

Example 27: The charger according to Example 26, wherein the user interface comprises a button.

Example 28: The charger according to any of Examples 24 to 27, wherein the ejection stage is configured for reverse operation of at least a part of one or both of the charging stage and the insertion stage.

Example 29: The charger according to any of the preceding examples, wherein the insertion mechanism comprises a motor mechanism, preferably a motorized gear.

Example 30: A kit comprising the charger according to any of the preceding examples and an aerosol-generating device and, optionally, an aerosol-generating article.

Example 31: The kit according to Example 30, wherein one or both of the charger, the aerosol-generating device, and the aerosol-generating article has an elongated shape.

Example 32: The kit according to Example 30 or Example 31, wherein a longitudinal axis of the charger, is parallel to a longitudinal axis of the aerosol-generating device, when the aerosol-generating device is inserted into the charger.

Example 33: A method for charging an aerosol-generating device comprising steps of:

providing a charger according to any of Examples 1 to 29;

providing and an aerosol-generating device;

moving the device along a first direction into the cavity; and moving the device along a second direction into the charging position.

Example 34: The method according to Example 33, wherein a longitudinal axis of the device is substantially parallel to a longitudinal axis of the charger while the device is being moved along one or both of the first direction and the second direction.

Example 35: The method according to Example 33 or Example 34, wherein the first direction is substantially orthogonal to the second direction.

Example 36: The method according to any of Examples 33 to 35, comprising a step of:

charging the device in the charging position.

Example 37: The method according to any of Examples 33 to 36, comprising a step of:

ejecting the device from the charging position into an ejection position.

Example 38: The method according to Example 37, wherein the step of ejecting the device from the charging position into an ejection position comprises reverse movement of the device out of the charging position along the second direction and along the first direction.

Features described in relation to one embodiment may equally be applied to other embodiments of the invention.

Figures 3, 3A, 3B, 3C:
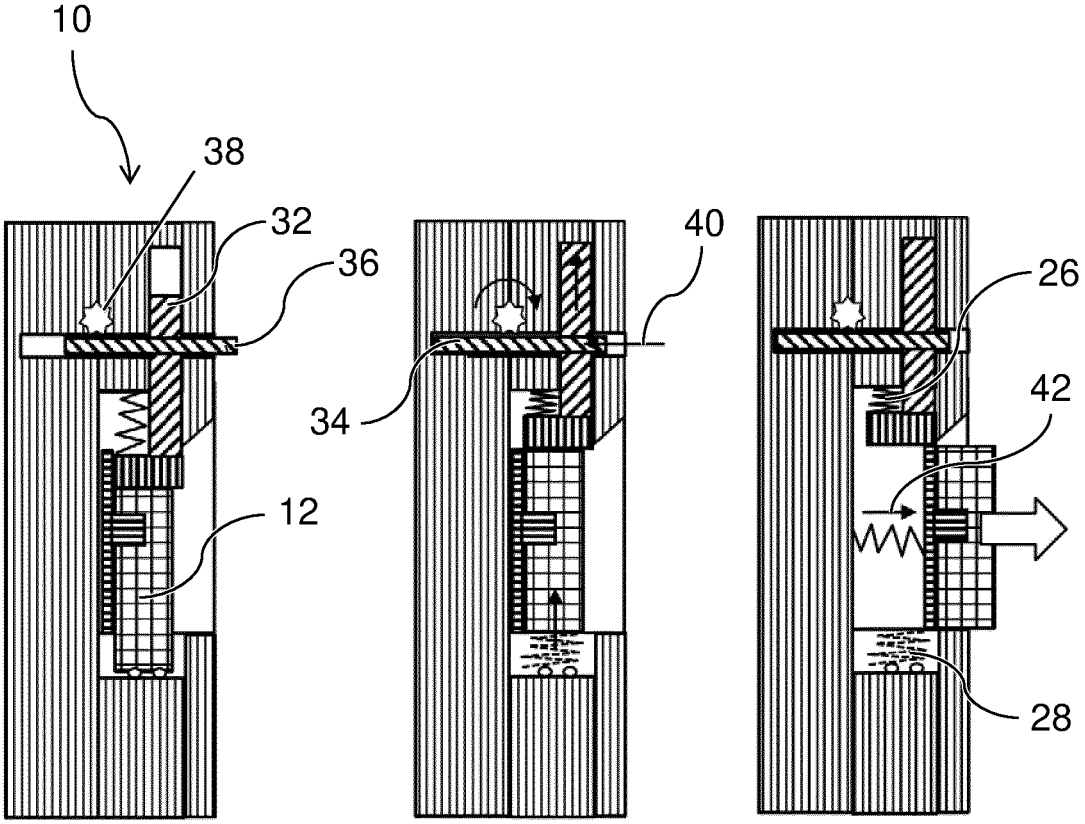
Figures 4, 4A, 4B, 4C:
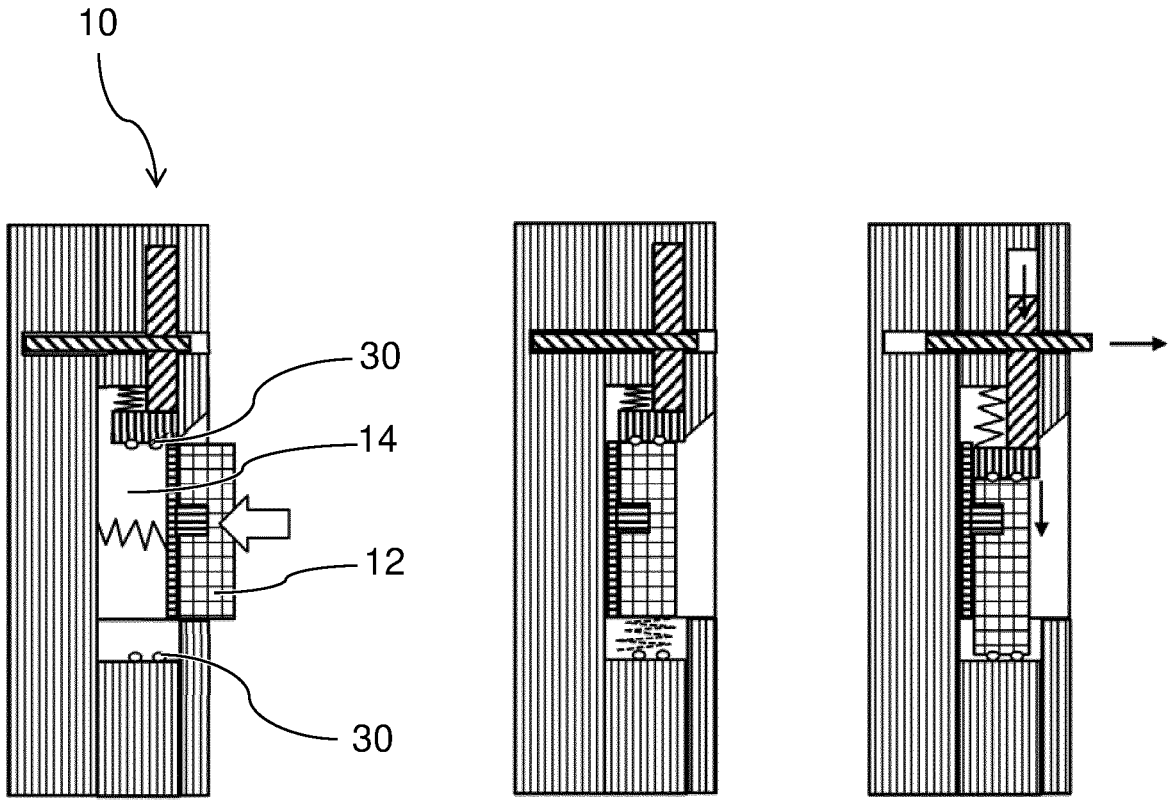

The invention will be further described, by way of example only, with reference to the accompanying drawings in which:

FIGS. 1*a* to 1*c* show operation of an insertion stage of a charger of the invention;

FIGS. 2*a* and 2*b* show operation of a charging stage of a charger of the invention;

FIGS. 3*a* to 3*c* show operation of an ejection stage of a charger of the invention; and FIGS. 4*a* to 4*c* show operation of an insertion stage and a charging stage of a charger of the invention.

FIGS. 1*a* to 1*c* show operation of an insertion stage of a charger 10 of the invention. The charger 10 and an aerosol-generating device 12 are shown in cross-sectional view. The charger 10 comprises a cavity 14 for receiving the device 12. The charger 10 comprises an insertion mechanism. The insertion mechanism comprises an insertion stage for inserting the device 12 into the cavity 14.

The charger 10 comprises an elongated opening 16 for lateral insertion of the device 12 into the cavity 14 via a longitudinal side of the device 12. The elongated opening 16 is arranged at a longitudinal side of the charger 10. The insertion direction is illustrated by an arrow. The charger 10 is arranged such that a longitudinal axis of the charger 10 is parallel to a longitudinal axis of the aerosol-generating device 12 when the device 12 is inserted into the opening 16. A sidewall 18 of the opening 16 has a funnel shape towards the cavity 14 for guiding the device 12 into the cavity 14.

The insertion stage comprises a clamp 20 for grasping the device 12 and initiating insertion of the device 12 as shown in FIG. 1*a*. The clamp 20 is mounted on a movable back wall 22 of the charger 10. The insertion stage is further configured for linearly moving the device 12 in a first direction from an initial insertion position as shown in FIG. 1*b* into a final insertion position as shown in FIG. 1*c*. The first direction is orthogonal to both of a longitudinal direction of the device 12 and a longitudinal direction of the charger 10.

The insertion mechanism comprises a first spring mechanism 24 configured for being activated during operation of the insertion stage. The first spring mechanism 24 is compressed during insertion of the device 12 and movement of the movable back wall 22. The end of operation of the insertion stage is shown in FIG. 1*c*.

FIGS. 1*a* to 1*c* also show a second spring mechanism 26 in its compressed state. The second spring mechanism 26 is part of the charging stage as explained below.

The charger 10 comprises a charging stage for moving the device from the final insertion position into a charging position as shown in FIGS. 2*a* and 2*b*.

FIG. 2*a* is mainly identical to FIG. 1*c* showing the end of operation of the insertion stage when the device is in the final insertion position. The sole difference between FIG. 1*c* and FIG. 2*a* is that FIG. 2*a* shows a counter spring mechanism 28. The counter spring mechanism 28 is weaker than the second spring mechanism 26. The counter spring mechanism 28 may be used to support ejection of the device 12.

The insertion mechanism is configured for automatically initiating operation of the charging stage at the end of operation of the insertion stage. The charging stage is configured for linearly moving the device in a second direction different from the first direction as indicated by the arrows in FIG. 2*b*. The second direction is substantially orthogonal to the first direction. FIG. 2*b* shows the final charging position. As shown in FIG. 2*b*, the cavity 14 is configured for completely enclosing the device 12 in the charging position.

The charging stage is configured for exerting a force along a longitudinal direction of the device 12 to so as to cause a vertical movement of the device 12 parallel to a longitudinal axis of the device 12 towards electrical contacts 30 of the charger 10. The charging stage is configured for exerting the force onto the device so as to press electrical contacts of the device 12 onto the electrical contacts 30 of the charger 10 in the charging position. The second spring mechanism 26 is configured for exerting the force onto the device 12. The second spring mechanism 26 is configured for automatically being activated at the end of operation of the insertion stage. The second spring mechanism 26 is configured for being activated when the device 12 is fully pushed against a backwall of the cavity 14 meaning that the movable back wall 22 is fully pushed towards the left-hand side. As shown in FIG. 2*a*, the second spring mechanism 26 is no longer blocked by the movable back wall 22 at the end of operation of the insertion stage. The second spring mechanism 26 can thus move vertically to push the electrical contacts of the device 12 on the electrical contacts 30 of the charger 10 as shown in FIG. 2*b*. The clamp 20 may assist a correct downward movement of the device 12. Furthermore, the charger 10 comprises mating gears of a vertical axial member 32, which has moved downward with the second spring mechanism 26 in FIG. 2*b*, and of a transversal axial member 34. The mating gears may help to convert the vertical downwards movement of vertical axial member 32 into a rectilinear outwards movement of the transversal axial member 34. By the outwards movement of the transversal axial member 34, a button 36 at the end of the transversal axial member 34 moves on the outside surface of the charger 10. The button 36 protrudes out of the charger 10, such that by pressing on the button 36 the mechanism may be moved back, releasing the force exerted on the device 12 by the second spring mechanism 26.

Additionally, the first spring mechanism 24 (not shown in FIG. 2) is held in its compressed state by the vertical axial member 34 which, when having moved downwards as shown in FIG. 2*b*, holds movable back wall 22 in position. Alternatively or in addition, the first spring mechanism 24 may also be held in position by means of a rotating hook or an electromagnet.

FIGS. 3*a* to 3*c* show a charger 10 of the invention with an additional ejection stage. The charger 10 may be the same charger 10 as shown in FIGS. 1 and 2. The insertion mechanism of the charger 10 shown in FIG. 3 comprises an ejection stage configured for partly removing the charged device 12 out of the cavity 14 into an ejection position where the device 12 can be easily grasped by a user.

FIG. 3*a* shows the charging position as it is also shown in FIG. 2*b*. Operation of the ejection stage may be automatically initiated when the device 12 is charged. Additionally or alternatively, a user may manually initiate operation of the ejection stage by pushing button 36. The ejection is realized by a motorized gear 38 connected to the mating gears of the vertical axial member 32 and the transversal axial member 34. The motorized gear 38 may also be used in reverse operation to bring the device from the end of operation of the insertion stage as shown in FIG. 2*a* into the final charging position shown in FIG. 2*b*.

FIG. 3*b* indicates by a curved arrow the rotation of the motorized gear 38. The transversal axial member 34 is drawn inside the charger 10 as indicated by another arrow 40. Due to the gear connection between the vertical axial member 32 and the transversal axial member 34, the vertical axial member 32 moves upwards compressing the second spring mechanism 26 and releasing the pressure on the device 12. The counter spring mechanism 28 can then push the device 12 up, back in the opening path as indicated by an arrow 42 in FIG. 3*c*.

FIG. 3*b* shows the vertical axial member 32 and the transversal axial member being fully retracted. The second spring mechanism 26 then does not block anymore the movable back wall 22. The first spring mechanism 24 can then push the device 12 outward the charger 10, where the user can pick it up easily as shown in FIG. 3*c*. FIG. 3*c* thus shows the ejection position. The ejection position corresponds to the initial insertion position.

A comparison of FIGS. 1-3 visualizes that the ejection stage is configured for reverse operation of the charging stage and the insertion stage.

FIGS. 4*a* to 4*c* successively show operation of an insertion stage and a charging stage of a charger 10 of the invention as explained above. In the embodiment of FIGS. 4*a* to 4*c*, the charger 10 comprises two sets of charging terminals 30 symmetrically arranged at opposing walls in the cavity 14, such that the device 12 can be charged when inserted in either up or down orientation. This is shown in FIG. 4*c* where the device 12 is in its final charging position.

The invention claimed is:

1. A charger for an aerosol-generating device, the charger comprising:

a cavity configured to receive the aerosol-generating device and an insertion mechanism, wherein the insertion mechanism comprises an insertion stage configured to insert the aerosol-generating device into the cavity, and a charging stage configured to move the aerosol-generating device into a charging position, and wherein the insertion mechanism is configured to automatically initiate operation of the charging stage at an end of operation of the insertion stage.

2. The charger according to claim 1, wherein the charging stage is configured for automatically moving the aerosol-generating device so as to bring electrical contacts of the aerosol-generating device into engagement with electrical contacts of the charger.

3. The charger according to claim 1, wherein the insertion mechanism further comprises an actuator configured for automatically initiating operation of the charging stage at the end of operation of the insertion stage.

4. The charger according to claim 1, wherein the charging stage is further configured for automatically moving the aerosol-generating device so as to bring electrical contacts of the aerosol-generating device into engagement with electrical contacts of the charger, and wherein the insertion mechanism comprises an actuator configured for automatically initiating operation of the charging stage at the end of operation of the insertion stage.

5. The charger according to claim 1, wherein the insertion stage is further configured to move the aerosol-generating device in a first direction, and the charging stage is further configured to move the aerosol-generating device in at least a second direction different from the first direction.

6. The charger according to claim 5, wherein the second direction is substantially orthogonal to the first direction.

7. The charger according to claim 1, wherein the charging stage is further configured to exert a force onto the aerosol-generating device so as to press electrical contacts of the aerosol-generating device onto electrical contacts of the charger in the charging position.

8. The charger according to claim 7, wherein the charging stage is further configured to exert the force along a longitudinal direction of the aerosol-generating device so as to cause a movement of the aerosol-generating device parallel to a longitudinal axis of the aerosol-generating device towards the electrical contacts of the charger.

9. The charger according to claim 7, wherein the charging stage comprises one or both of a spring mechanism and a motor mechanism configured to exert the force onto the aerosol-generating device and configured to be activated at the end of operation of the insertion stage.

10. The charger according to claim 9, wherein the one or both of the spring mechanism and the motor mechanism is further configured to move a button to protrude out of a charger outside surface, such that by pressing on the button the one or both of the spring mechanism and the motor mechanism may be moved back, releasing the force exerted on the device.

11. The charger according to claim 1, further comprising an elongated opening configured for lateral insertion of the aerosol-generating device into the cavity via a longitudinal side of the aerosol-generating device, wherein the elongated opening is arranged at a longitudinal side of the charger, and wherein the charger is arranged such that a longitudinal axis of the charger is parallel to a longitudinal axis of the aerosol-generating device when the aerosol-generating device is inserted into the elongated opening.

12. The charger according to claim 1, wherein the cavity is further configured to completely enclose the aerosol-generating device in the charging position.

13. The charger according to claim 1, further comprising two sets of charging terminals symmetrically arranged at opposing walls in the cavity, such that the aerosol-generating device can be charged when inserted in either up orientation or down orientation.

14. The charger according to claim 1, wherein the insertion mechanism further comprises an ejection stage configured to partly remove the charged aerosol-generating device out of the cavity into an ejection position.

15. The charger according to claim 14, wherein operation of the ejection stage is automatically initiated when charging of the aerosol-generating device is completed.

16. The charger according to claim 14, wherein the ejection stage comprises a user interface configured for a user to manually initiate operation of the ejection stage.

17. A kit comprising the charger according to claim 1 and an aerosol-generating device.

18. The kit according to claim 17, further comprising an aerosol-generating article.

19. A method for charging an aerosol-generating device, the method comprising steps of:

providing a charger according to claim 1;

providing the aerosol-generating device;

moving the aerosol-generating device along a first direction into the cavity of the charger; and moving the aerosol-generating device along a second direction into the charging position.

* * * * *